United States Patent [19]

Heredia

[11] 4,015,802

[45] Apr. 5, 1977

[54] KITE CONSTRUCTION

[76] Inventor: Romeo Victor Heredia, 5648 Waring Road, San Diego, Calif. 92120

[22] Filed: Jan. 12, 1976

[21] Appl. No.: 648,369

Related U.S. Application Data

[63] Continuation of Ser. No. 536,404, Dec. 26, 1974, abandoned.

[52] U.S. Cl. ..... 244/153 R

[51] Int. Cl.[2] ..... B64C 31/06

[58] Field of Search ..... 244/153 R, 154, 155 R, 244/155 A, 33; D34/15 AF

[56] References Cited

UNITED STATES PATENTS

| | | | |
|---|---|---|---|
| 713,381 | 11/1902 | Battersby | 244/153 R |
| 2,484,096 | 10/1949 | Kay | 244/153 R |
| 3,116,902 | 1/1964 | Gould | 244/153 R |
| 3,335,984 | 8/1967 | Holland | 244/153 R |
| 3,357,660 | 12/1967 | Condrashoff | 244/153 R |
| 3,770,230 | 11/1973 | Johnston | 244/155 A |

FOREIGN PATENTS OR APPLICATIONS

| | | | |
|---|---|---|---|
| 288,534 | 6/1967 | Australia | 244/153 R |

*Primary Examiner*—Trygve M. Blix
*Assistant Examiner*—Barry L. Kelmachter
*Attorney, Agent, or Firm*—Brown and Martin

[57] ABSTRACT

A kite having a flying surface of flexible plastic sheet material supported from a single vertical rib and one or more cross-ribs. The ribs are attached to the sheet material at the left, right, upper and lower terminal portions of the sheet material by pockets of flexible material that are bonded to the sheet material. The cross-rib is a solid aluminum rod of uniform diameter which is biased into a symmetrical bend. An adjustable bridle is provided comprising upper and lower bridle members. The upper bridle member also serves as a point of attachment for the cross-rib to the vertical rib. The bridle incorporates centering beads on the end loops of the bridle members. The end loops are received over the vertical rib. The centering beads act to equalize and align the forces transferred to the kite string.

10 Claims, 6 Drawing Figures

KITE CONSTRUCTION

This is a continuation division, of application, Ser. No. 536,404, filed Dec. 26, 1974 now abandoned.

BACKGROUND OF THE INVENTION

Polyethylene sheet material or comparable flexible plastic sheet material has been used in kite construction for some time. The material has known advantages in kite construction including its relatively high strength, water-proof characteristics, repairability, durability, and light weight. However, conventional kite designs incorporating polyethylene sheet material have normally required the use of peripheral ribs along the edges of the sheet material to support the sheet material and maintain a desired configuration for the kite. As a result, kites utilizing plastic sheet material in the past have been heavy, and cannot be flown in relatively light winds.

A further deficiency of prior art kites is the fact that there has been no practical substitute found for wooden ribs. Plastic or metal tubular ribs have been employed in some cases but their use has necessitated the employment of elaborate connectors, such as a central spider connector to interconnect the cross-rib and vertical rib. Thus, the overall performance of kites has been limited by the inherent deficiencies of wooden ribs including the tendency of such ribs to swell and bend with variations in humidity, their relatively low overall structural strength and the difficulty of connecting a bridle to the vertical rib in such a manner that a self-centering alignment effect is obtained as the end loops of the bridle pass over the edges of the substantially rectangular cross-section of the rib.

The various structural deficiencies of prior art kites have resulted in kite performance that is limited to certain predetermined wind conditions. For example, a particular kite may have acceptable flying conditions under light winds but may not have sufficent strength or rigidity to fly under heavier wind conditions. Additionally, the structural configuration of prior art kites results in asymmetrics in the flying surface of the kite due to an asymmetrical or off-centered condition in one or more of the supporting ribs and/or bridle members. Such an asymmetrical condition produces an instability in the flight of the kite, which must be compensated by a tail or other corrective member with a resultant reduction in performance.

Therefore, it is desirable to have an improved kite construction that provides a light-weight, high-strength kite with consistent performance characteristics in a wide range of wind conditions.

SUMMARY OF THE INVENTION

An exemplary embodiment of the invention incorporates a flying surface of flexible sheet material. The construction of the invention lends itself most advantageously (but is not limited) to kite configurations known generally as Indian Fighter kites incorporating a generally rectangular or square flying surface. The left, right, upper, and lower terminal portions of the flying surface then correspond to the four apices of the square surface. Attachment means are provided on the flying surface at each of the terminal portions. In the exemplary embodiment, the attachment means comprises a pocket of flexible material oriented to receive a rib through the open end thereof. In the case of the upper and lower terminal portions the open ends of the pockets are oriented along the vertical axis of the kite to receive a vertical rib. The dimensions of the pocket are sufficiently larger than the overall cross-sectional dimensions of the vertical rib to permit a free movement adjustability of the positioning of the vertical rib within the pocket.

The left and right attachment means are oriented to recieve a cross-rib and bias the same into a uniform curvature. The pockets are of sufficient size to permit free movement adjustability and also to permit the accommodation of one or more additional ribs of flights in high winds.

The cross-rib is secured to the vertical rib and to the flying surface through an end loop of the bridle. The bridle comprises upper and lower bridle members in the form of strings having end loops for attachment over the vertical rib and a plurality of adjustment loops at their opposite ends to provide for an adjustable length connection to the opposite bridle member. The two bridle members are interconnected by a releasable latch. The releasable latch may be a snap-swivel such as is utilized with fishing gear. The end loops of each of the bridle members have two centering beads received thereover. The purpose of the centering beads is to ride over the edges of the generally rectangular cross-section vertical rib and thereby to prevent the bridle from becoming lodged in a left or right orientation by a self-centering aligning effect.

The cross-rib is comprised of a symmetrical rod which has a greater length than the distance between the left and right attachment means. The invention contemplates the use of a symmetrical rod which tapers along its length equally in the left and right directions from center. However, in the instant embodiment it has been found to be particularly advantageous to utilize a solid core aluminum rod of uniform diameter.

It is therefore an object of the invention to provide a new and improved kite construction.

It is another object of the invention to provide a new and improved kite construction that is relatively low in cost.

It is another object of the invention to provide a new and improved kite construction that is relatively low in weight.

It is another object of the invention to provide a new and improved kite construction that has a high strength.

It is another object of the invention to provide a new and improved kite construction that maintains a uniform and symmetrical flying configuration.

It is another object of the invention to provide a new and improved kite construction with a self-centering bridle.

It is another object of the invention to provide a new and improved kite construction that makes effective use of polyethylene sheet material.

It is another object of the invention to provide a new and improved kite construction that may be easily assembled and disassembled.

It is another object of the invention to provide a new and improved kite construction that does not require peripheral ribs.

Other objects and many attendant advantages of the invention will become more apparent upon a reading of the following detailed description together with the drawings in which like reference numerals refer to like parts throughout, and in which:

DETAILED DESCRIPTION OF THE EXEMPLARY EMBODIMENT

Figure 1:
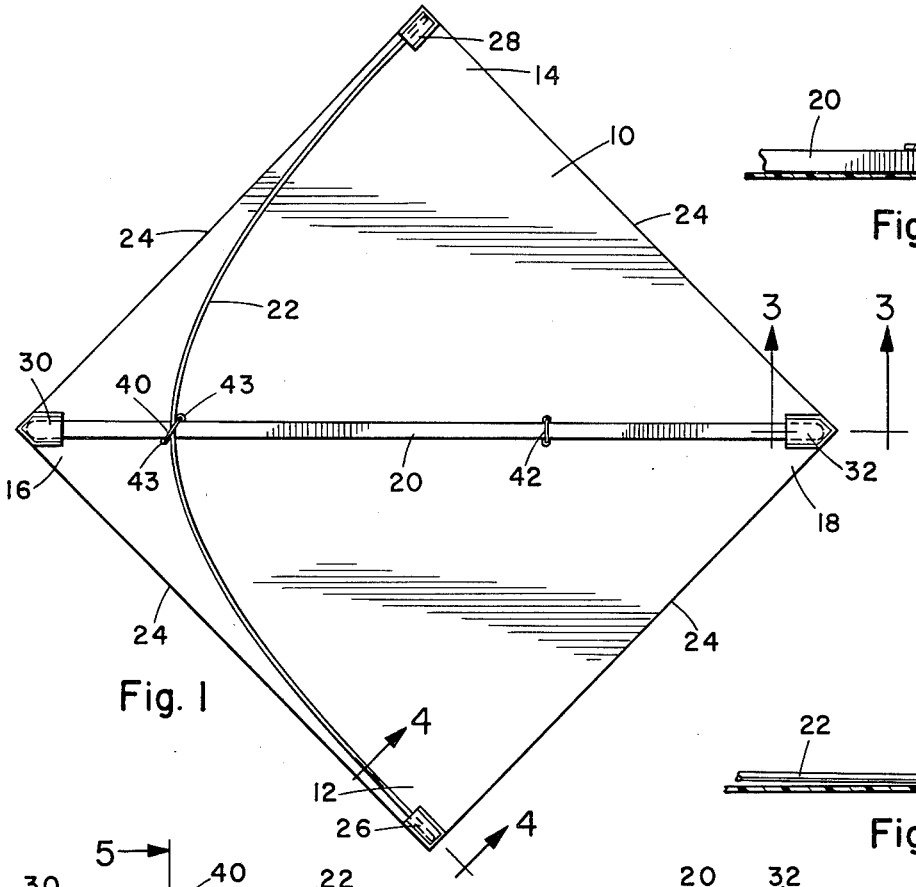
FIG. 1 is a top plan view of the kite.
Figure 3:
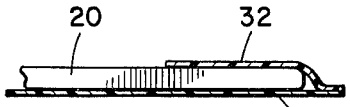
FIG. 3 is an enlarged sectional view taken on line 3—3 of FIG. 1.
Figure 4:
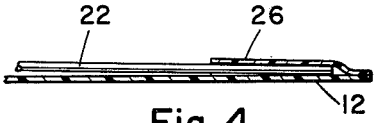
FIG. 4 is an enlarged sectional view taken on line 4—4 of FIG. 1.
Figure 2:
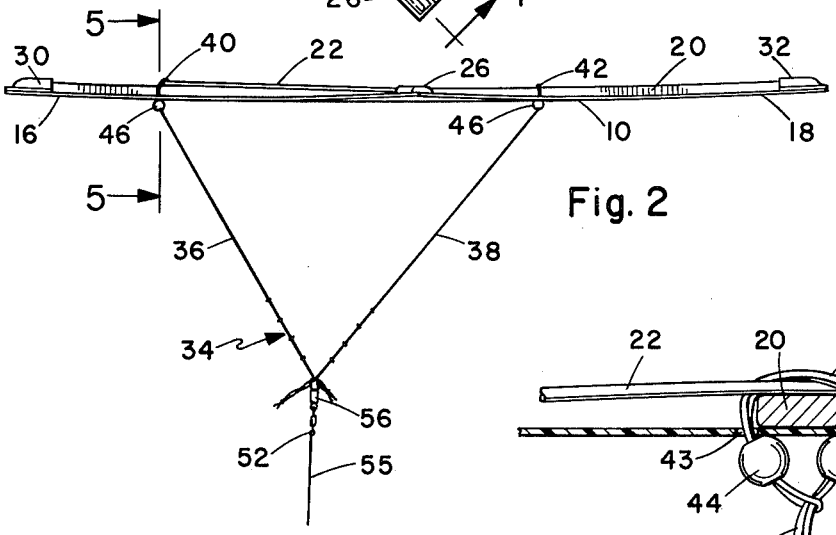
FIG. 2 is a side elevation view of the kite and bridle.
Figure 5:
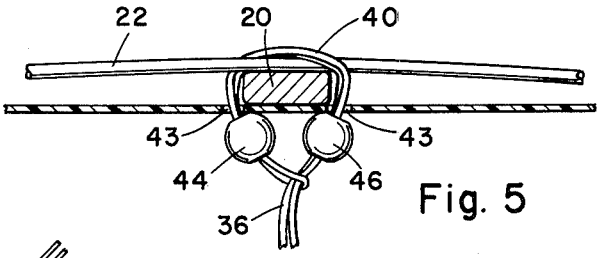
FIG. 5 is an enlarged sectional view taken on line 5—5 of FIG. 2.
Figure 6:
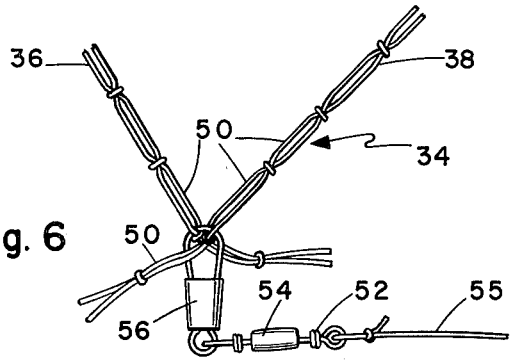
FIG. 6 is an enlarged side elevation view of the bridle and tether connection.

Referring now to the drawings, there is illustrated an improved kite according to the invention and utilizing flexibile sheet material 10. In the exemplary embodiment the sheet material 10 employed in polyethylene film. Such film is light in weight and has a good strength. In prior art kites, it has been difficult or expensive to provide appropriate points of attachment between the film and the structural members of the kite. As will appear more fully hereinafter, the unique attachment means of the invention have provided a means of attaching the polyethylene material to the structural members in a manner that provides a high strength kite which is, at the same time, light in weight.

In the exemplary embodiment, the sheet material is configured as a square so that the right, left, upper and lower terminal portions 12, 14, 16 and 18 correspond to the apex portions of the square. Thus, the exemplary kite corresponds generally to the type of kite known as an Indian Fighter kite. A vertical rib 20 extends diagonally between the upper and lower terminal portions 16 and 18 and may advantageously be a wooden rib of generally rectangular cross-section. The vertical rib 20 is received in the upper and lower attachment means. The upper and lower attachment means are in the form of pockets 30 and 32 of plastic flexible sheet material and may be heat bonded or adhesively bonded directly to the flying surface. The size of the pockets is such that a loose fitting engagement relationship with the vertical rib is produced. The distance between the pockets is such that the rib will not be accidently dislodged, but the rib is otherwise free to move within the pockets to orient itself in a self-aligning action.

Similarly, the cross-rib 22 is received in attachment means comprising pockets 26 and 28 at the right and left terminal portions 12 and 14. The open ends of the pockets 26 and 28 however, are generally oriented along ther terminal edges 24 of the sheet material toward the upper terminal portion 16. The length of the cross-rib 22 is such, that by insertion of the cross-rib into the pockets 26 and 28, a biased curvature for the cross-rib 22 is produced.

The biasing of the cross-rib into this curvature produces a resilient biasing effect on the sheet material that stretches the terminal portions 24 of the sheet material 10 between the lower terminal portion 18 and the right and left terminal portions 12 and 14 by the resilient biasing action of the rod. At the same time, the end thrust of the rod in the pockets 26 and 28 stretches the terminal edges 24 between the pockets 26 and 28 and the upper terminal portion 16. Thus, the single cross-rib 22 performs all of the functions normally associated with cross-ribs and in addition, performs the functions of stiffening peripheral ribs found in other designs.

The degree of bend required to accomplish these functions for the cross-rib could not be accommodated by conventional wood ribs. However, applicant has discovered that a solid aluminum cross-rib of uniform diameter has the requisite strength and resiliency. 70-75-T6 or 20-24-T4 aluminum alloy have been found to be especially suited to the purposes of the invention. Since such aluminum rods are substantially completely homogeneous and uniform throughout their length, the curvature generated also is uniform. As a result the flexing of the flying surface is uniform so that a stable and consistent flying performance is obtained.

The central portion of the cross-rib 22 is secured to the vertical rib 20 and flying surface 10 by the end loop 40, of the bridle 34. The bridle 34 comprises upper and lower bridle members 36 and 38. Upper bridle member 36 terminates in end loop 40 which end loop is threaded through holes 43 in the flying surface 10, around the vertical rib 20 and cross-rib 22 to interconnect the ribs and flying surface in addition to providing an attachment point for the bridle. In a similar manner, the lower bridle member 38 is fastened to the vertical rib 20 by an end loop 42. Each of the end loops 40 and 42 incorporate a pair of beads 44 and 46 which are strung on the end loops and act as centering beads to insure that the end loop will not become lodged in either a right or left hand orientation but rather will maintain a centered aligned orientation with the vertical rib 20. The self-centering end loops therefore contribute to stable flying characteristics.

The outer terminal portions of the upper and lower bridle members 36 and 38 are provided with a series of loops 50. A releasable latch comprising a snap latch 56 may thereby be engaged with a selected pair of loops 50 to control the overall length of the bridle and the relative lengths of the upper and lower bridle members. The snap latch 56 comprises a part of a snap-swivel 52. The snap-swivel 52 also incorporates a swivelling section 54 so that maneuvering of the kite will not twist kite string 55. The kite will accommodate a wide range of wind conditions without adjustment in the bridle. However, for extreme conditions the user may easily adjust the bridle to maintain stable flying performance. The kite may be strengthened to withstand heavy winds by adding additional cross-ribs.

Having described my invention, I now claim:

1. An improved kite construction comprising:

a flying surface of flexible sheet material in a four sided polygon with four corners comprising upper, lower, right and left terminal portions, an elongated vertical rib extending between said upper and lower terminal portions, at least one elongated cross rib extending between said left and right terminal portions, attachment means secured to each of said corners for receiving and retaining the ends of said vertical rib and said cross rib, said cross rib having a length that is substantially greater than the distance between said left and right terminal portions so that said cross rib is forced to assume a bowed configuration, a bridle means secured at spaced points to said vertical rib for attaching said kite to a kite string, said bridle is secured around said vertical rib with an end loop at each of said spaced points, a pair of beads are strung on each of said end loops and bear against said vertical rib through said sheet material.

2. An improved kite construction according to claim 1, wherein:

said flying surface is comprised of polyethylene film sheet material.

3. An improved kite construction according to claim 1, wherein:

at least the attachment means for the left and right terminal portions comprise pockets of flexible material having an opening substantially greater than that of the outside dimensions of said cross-rib, said pockets are secured to said sheet material.

4. An improved kite construction according to claim 3, wherein: said pockets are secured by heat bonding.

5. An improved kite construction according to claim 3, wherein: said pockets are secured by adhesive bonding.

6. An improved kite construction according to claim 1, wherein:

said bridle comprises an upper and lower bridle members and a releasable latch means, each of said bridle members terminates in a plurality of loops, said latch means for selectively engaging one of said plurality of loops on each of said bridle members.

7. An improved kite construction according to claim 3 wherein:

said pockets comprise a single layer of flexible material secured to one surface of said sheet material along the peripheral edges of said flexible material excepting at said opening.

8. An improved kite construction according to claim 1 wherein:

said cross rib comprises a symmetrical aluminum rod having a circular cross section, said rod is solid and has a uniform diameter throughout the length of said rod.

9. An improved kite construction according to claim 1 wherein: said vertical rib has a generally rectangular cross section.

10. An improved kite construction according to claim 1 wherein: said bridle is secured around said vertical rib and said cross rib at the upper terminus of said bridle.

* * * * *